United States Patent [19]

Christiansen

[11] Patent Number: 4,884,917

[45] Date of Patent: Dec. 5, 1989

[54] FLOW MODIFICATION AT THE BIFURCATION OF A BRANCH CHANNEL FROM A MAIN CHANNEL CARRYING A WATER FLOW

[75] Inventor: Hermann Christiansen, Bucholz, Fed. Rep. of Germany

[73] Assignee: Robert Kirby, United Kingdom

[21] Appl. No.: 163,838

[22] Filed: Mar. 3, 1988

[30] Foreign Application Priority Data

Mar. 5, 1987 [DE] Fed. Rep. of Germany ..... 3707074

[51] Int. Cl.[4] ..... F02B 3/00

[52] U.S. Cl. ..... 405/80; 405/74; 405/52

[58] Field of Search ..... 405/15, 25, 73, 74, 405/21, 23, 28–35, 80, 81, 83; 137/561 A; 244/53 B; 285/155, 156; 138/39

[56] References Cited

U.S. PATENT DOCUMENTS

| | | | |
|---|---|---|---|
| 807,987 | 12/1905 | Ambler | 405/80 |
| 2,068,537 | 1/1937 | Dorn | 405/28 |
| 2,292,246 | 8/1942 | Steffens | 138/39 |
| 2,813,708 | 11/1957 | Frey | 138/39 X |
| 3,667,234 | 6/1972 | De Lizasoain | 405/80 |
| 4,360,432 | 11/1982 | Kieronski | 138/39 X |
| 4,740,105 | 4/1988 | Wollander | 405/83 |

*Primary Examiner*—Randolph A. Reese
*Assistant Examiner*—Arlen L. Olsen
*Attorney, Agent, or Firm*—Thomas J. Greer, Jr.

[57] ABSTRACT

An arrangement for opposing the formation of eddies and diminishing the deposition of sediment at the junction of a branch channel with a main, water carrying channel. The upstream corner of the intersection of the channels is provided with a deflector to divert some of the main channel water into the branch channel. The deflector is in the form of a curved, vertically disposed wall extending the full depth of the water.

13 Claims, 5 Drawing Sheets

FLOW MODIFICATION AT THE BIFURCATION OF A BRANCH CHANNEL FROM A MAIN CHANNEL CARRYING A WATER FLOW

BACKGROUND OF THE INVENTION

The invention relates to the modification of water flows, particularly at bifurcations in water channels. Such bifurcations occur in natural river channels and tidal waterways as well as in artificial basins, docks, canals etc.

It has been observed in nature that in many circumstances an eddy current is generated as a result of flow separation immediately within the entrance to a bifurcation (see FIG. 1) and leads to the deposition of sediment. In uni-directional flows, i.e. rivers, the water level changes in height only slowly and such eddy systems, in which the flow rotates about a vertical axis, are set up at bifurcations due to flow separations induced by sharp changes in the orientation of the bank. Such separations are enhanced by velocity gradients between the water in the river channel passing the entrance to the branch and the branch itself, where the velocity, in the case of blind-ending branches, may be zero.

In simple river channels with no tidal effect there is no superimposed advection of water through the eddy system to fill the branch. In tidal waters eddy rotation is supplemented by advection of water into the basin on a rising tide. In either case, a portion of the water drawn into the eddy may eventually escape and enter the side branch whilst another portion may escape and return to the main stream.

In bidirectional or tidal flows, the water level changes in height regularly and in relative terms, rapidly. On rising stages of the tide in these situations it has been observed that a quantity of water larger than that strictly necessary to fill a branch basin at high tide may be exchanged at the entrance to the bifurcation. This implies that the eddy is both drawing in water to fill the basin on the rising tide and also exchanging water back into the main flow. The quantity of water exchanged is difficult to estimate, but in some cases may be two or three times the tidal volume of the basin. (The tidal volume is the surface area multiplied by the tidal range). The strength and persistence of the eddy and also the volume of water which passes through the eddy contribute to its efficiency in trapping and depositing sediment.

In blind-ending bifurcations, such as harbour basins in tidal waters, the importance of the eddy current depends in part on the size and extent of the harbour basin. In small harbour basins the eddy current may occupy the whole area of the basin, whilst in larger basins the eddy may occupy only the entrance to the basin.

The rotary motion in such eddy currents may, in itself, be undesirable in that the strong cross-currents induced may present control difficulties for vessels, of necessity moving slowly whilst entering the branch, but it is also known that large quantities of sediment frequently accumulate on the channel bed beneath such eddy currents. Deposition arises as a result of the so-called "tea-cup effect": as a result of the pressure gradients and the velocity distribution within a rotating eddy, sediment is drawn into its axial region. Such sediment cannot readily escape from the centre of the eddy with the result that a certain proportion of it is deposited. In small harbour basins, with or without a tidal influence, where the eddy fills the entire basin, the entirety of the sedimentation occurring arises from this so-called tea-cup effect. In large harbour basins, with a tidal influence, it has been observed that up to 50% of the sedimentation occurring arises from the tea-cup effect and deposition is concentrated just within the harbour entrance. At waterway bifurcations without blind-ends, such as the branches of rivers or canals, the tea-cup effect is still present and leads to such sediment as is deposited being concentrated in the zone beneath the eddy.

Sedimentation caused by eddy currents in any of the cases described above and in the quantities specified results in high costs for dredging and maintaining navigable waterways. Costs are enhanced when such material is highly contaminated by pollutants and has to be transported long distances or placed in special containment or spoil-disposal areas ashore.

OBJECT OF THE INVENTION

The object of the present invention is to provide means for breaking down or preventing the formation of such eddy currents so as to reduce the quantity of sediment deposited or at least to spread it as a thinner layer over a wider area. Both of these factors would give rise to a major benefit, either from a reduction in the quantity of sediment to be removed or in the frequency with which dredging operations have to be carried out. For example, in one example of a bifurcated channel from which data is available, the average annual sediment deposition is close to 600,000 $m^3$, of which half occurs in close association with the eddy at the entrance. If the destruction of the eddy were to lead to an improvement of only 50% in the amount of deposition in this region a decrease in the annual dredging need for the basin of 150,000 $m^3$ would result.

BRIEF STATEMENT OF THE INVENTION

Accordingly the invention provides, in a bifurcated channel comprising a main channel carrying a water flow and a branch channel bifurcating from said main channel, flow deflecting means located adjacent the upstream corner of the bifurcation relative to the direction of said water flow and arranged to deflect a minor proportion of said water flow into the branch channel so as to oppose the formation of eddies in the branch channel in the region of said bifurcation.

In effect, the flow deflecting device of the invention tends to set up an eddy which would rotate in the opposite sense from that induced in the main flow from the main channel into the branch channel and hence counteracts the main eddy so that eddying at the bifurcation is at least reduced if not entirely prevented.

In preferred embodiments of the invention, the flow deflecting means comprise a passive device which, once installed, requires no supplementary operating energy but simply harnesses the natural energy of the flowing water. In other words, it involves no running costs. To this end, the flow-deflecting means may consist of a wall which defines a deflection channel extending adjacent the upstream corner of the bifurcation and having an inlet in the main channel and an outlet in the branch channel. The wall may extend the full depth of the water or only part of this depth in which case it may be located in the upper or the lower part of the water channel and it may be constructed from concrete, metal, wood or other materials as appropriate.

The provision of the deflecting wall will narrow the entrance to the branch channel if no other changes are made but this is compensated for, in navigational terms, by the reduction of the strong cross-currents at the entrance. Depending on the configuration of the bifurcation, the upstream corner of the bank around which the deflection channel is formed may, in any case, be modified; a sharp corner may, for example, be cut away so that the deflection channel follows a smooth curve arount it, or a subsidiary wall may be built up around the corner itself or so as to project from the corner into the branch channel to deflect water in the deflection channel towards the centre of the channel rather than parallel to the bank.

It will be appreciated that the structure of the flow-deflecting means and the proportion of the main flow directed into the branch channel can be varied widely according to the configuration of a bifurcation and the flow criteria operating there but some specific embodiments of the invention will now be described by way of example, with reference to the accompanying drawings.

DESCRIPTION OF THE PREFERRED EMBODIMENTS

Figure 1:
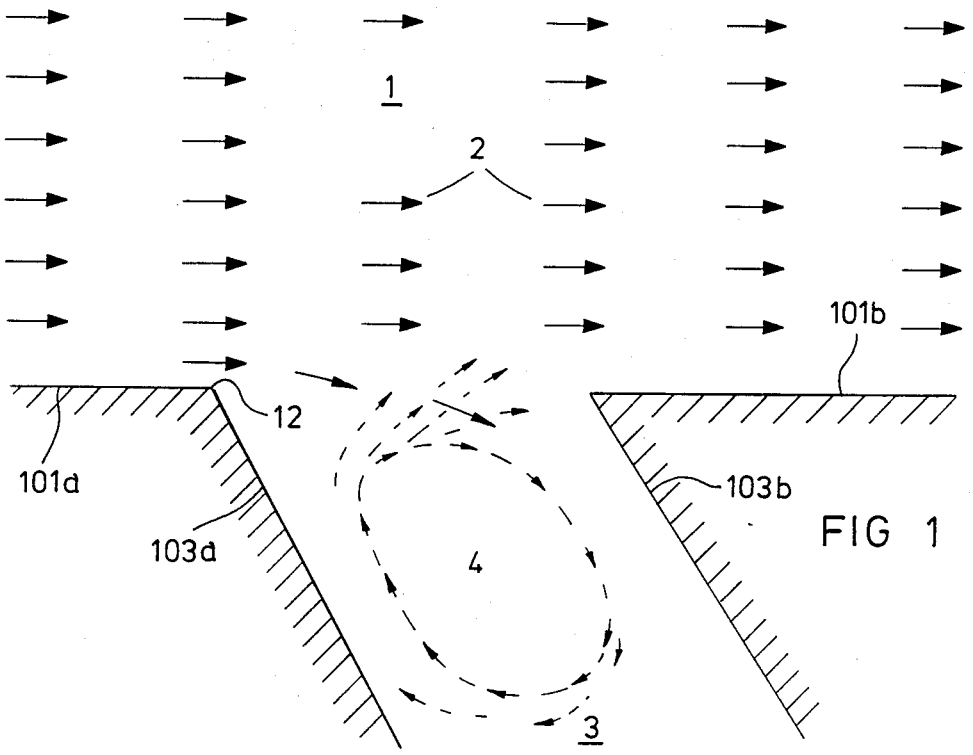
FIG. 1 is a schematic plan view of an eddy system generated by flow separation at a bifurcation.

With reference to FIG. 1 of the drawings a main water channel is shown at 1 and contains water flowing in the direction of the arrows 2 in an upstream to downstream direction. A branch channel 3 bifurcates from the channel 1 and water on entering the branch channel 3 from the main channel 1 forms eddies indicated by the arrows 4. The bank of the main channel is indicated 101*a* upstream of the bifurcation and 101*b* downstream of the bifurcation while the bank of the branch channel 3 which continues from the bank 101*a* is indicated 103*a*, the opposite bank being indicated 103*b*. The corner joining the banks 101*a* and 101*b* is indicated 12 and is termed an upstream corner of the entrance to the branch while the corner joining banks 101*b* and 103*b* is termed a downstream corner.

Figure 2:
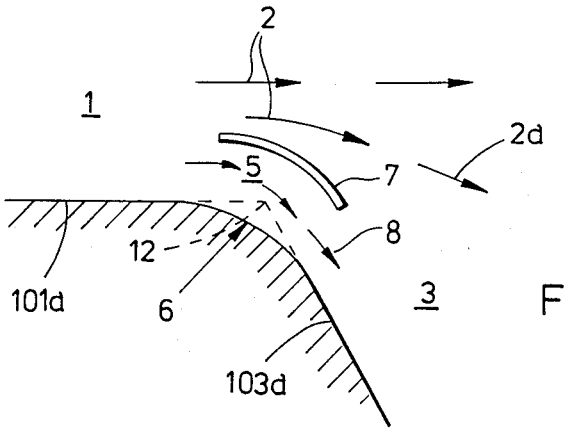
FIG. 2 is a schematic plan view of the bifurcation of FIG. 1 according to a first embodiment of the invention.

FIG. 2 shows a modification of the bifurcation of FIG. 1 by the provision of a flow-deflecting channel 5 at the bifurcation, around the upstream corner 12 from the main channel 1 to the branch channel 3. The channel 5 is formed by rounding of the corner 12 as shown at 6 and by the building of a vertical wall 7, spaced from the corner 6, and extending from the channel 1 into the channel 2. The wall may, for example, be a sheet-piled steel wall and extends the full depth of the water in the two channels 1 and 3 and confines the flow-deflecting channel 5 between it and the curved corner 6, such that the channel 5 has its inlet in the main channel 1 and its outlet in the branch channel 3. The channel 5 thus deflects a small proportion of the water flow 2 from the channel 1 into the channel 3, as indicated by the arrows 8. This flow counters the main flow from the channel 1 into the branch channel 3, indicated by the arrow 2*a*, to reduce eddying at the bifurcation.

As shown in FIG. 2, the flow deflection channel 5 is of uniform section but its shape could be modified as required at a particular bifurcation by changing the curve of the bank at 6 or the line of the wall 7. In particular it can be useful to narrow the exit of the channel 5 compared with its inlet to increase the speed of the water flow through the channel 5.

Figure 3:
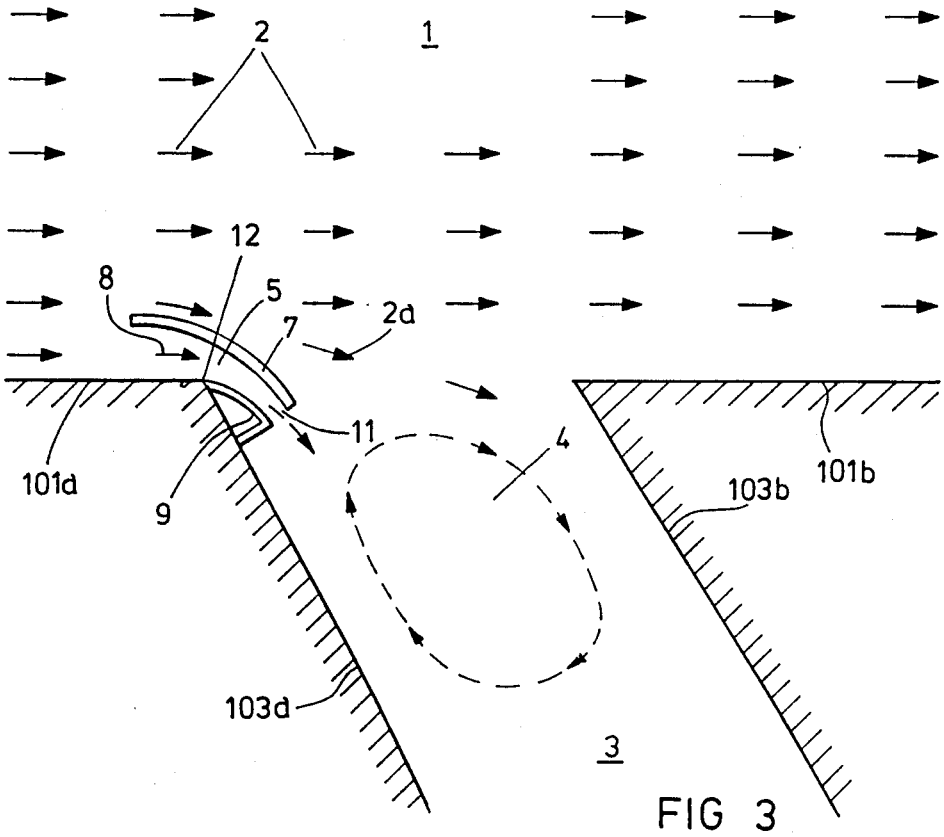
FIG. 3 is a schematic plan view of the bifurcation of FIG. 1 according to a second embodiment of the invention.

With reference to FIG. 3 of the drawings, in this embodiment the flow deflecting means include a flow-deflecting wall similar to the wall 7 of FIG. 2, indicated by the same reference numeral and bounding a flow deflecting channel again indicated 5. In this embodiment, however, the opposite bank of the channel 5 is formed not by cutting away of the original corner 12 but by the addition of a curved spur wall, indicated 9, which extends from the corner 12 into the channel 3. The gap between the ends of the wall 9 and the bank 103*a* is closed by a further wall or by complete infilling of the space between the bank 103*a* and the wall 9.

In FIG. 3 the channel 5 is shown tapering towards its outlet but this configuration may be changed according to requirements. The channel 5 serves the same purpose as that shown in FIG. 2 and the eddy current which would normally tend to form at the bifurcation, and which is opposed by the current 8, is shown by broken arrows at 4.

Figure 4:
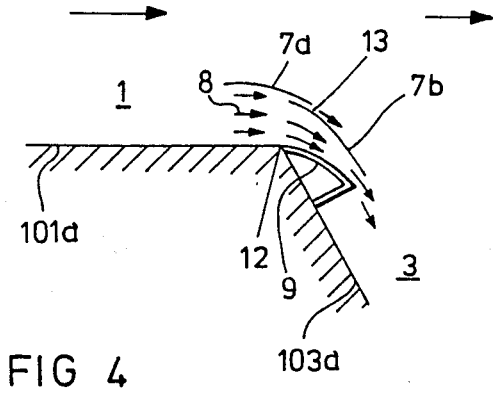
FIG. 4 is a schematic plan view of the bifurcation of FIG. 1 according to a third embodiment of the invention.
Figure 5:
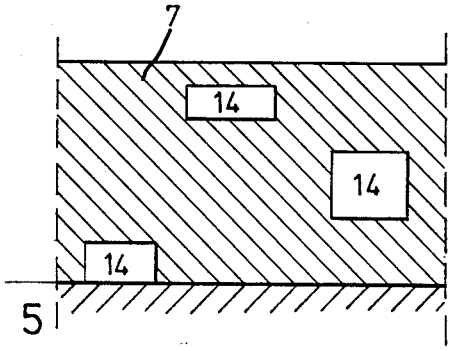
FIG. 5 a a partial side elevational view of a flow deflecting wall according to a fifth embodiment of the invention.

FIG. 4 shows a variation on the arrangement of FIG. 3. Here, the single wall 7 is replaced by two overlapping walls 7*a* and 7*b* which define a narrow, subsidiary channel 13 between them, in addition to the main flow-deflection channel 5, the entrance to the channel 13 being within the channel 5. The purpose of this subsidiary channel is to stop the development of additional, smaller eddies in the boundary area between the main channel 1 and the branch channel 3, in the lee of the wall 7. A comparable effect may be achieved by forming apertures or "windows" in a deflecting wall 7, as shown at 14 in FIG. 5.

If desired, the wall 7 can be designed so that only certain layers in the upper and/or lower region of the water body are deflected into the deflection channel 5, while still stopping the development of the major eddy.

To this end, a wall occupying only part of the overall depth of the water may be built on the channel bed or supported above it by means of piles or floats.

Figure 6:
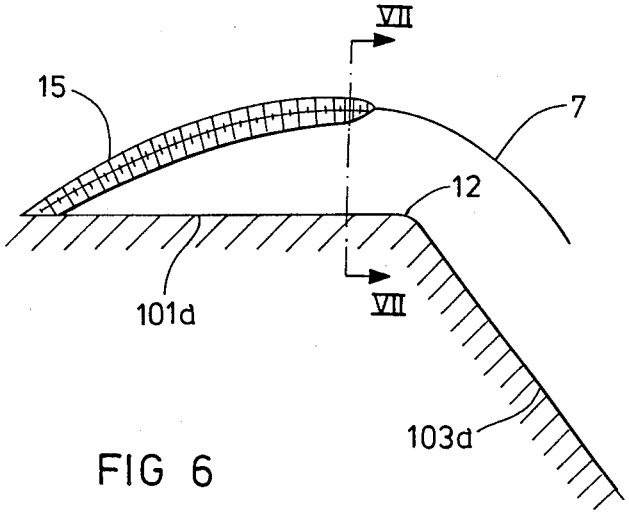
FIG. 6 is a schematic plan view of the upstream corner of a channel bifurcation modified by the provision of flow-deflecting means according to a sixth embodiment of the invention.
Figure 7:
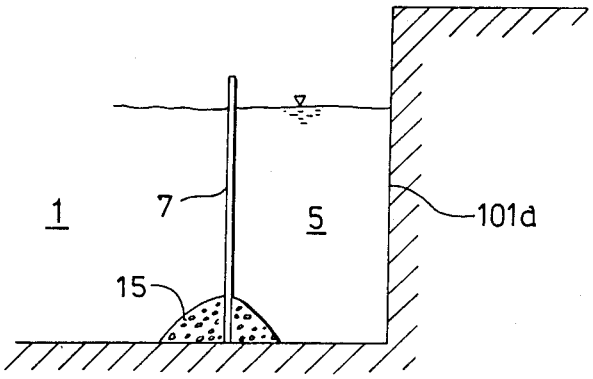
FIG. 7 is a cross-section taken along the line VII—VII of FIG. 6.
Figure 9:
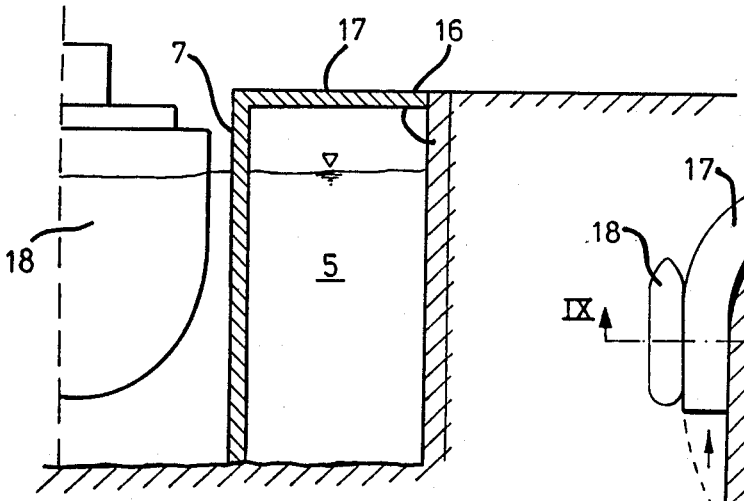
FIG. 9 is a cross-section taken on line IX—IX of FIG. 8.

With reference to FIGS. 6 and 7, these show the positioning of a low guiding wall, or underwater groyne, 15 of roughly conical section in front of the entrance to the flow-deflection channel 5 in order to deflect bedload and highly concentrated suspended matter which moves just above the main channel bed and prevent this from entering the channel 5. The groyne 15 extends from the foot of the wall 7 at the entrance to the channel 5 in a direction upstream and across the entrance to meet the upstream bank 101*a* of the main channel 1. The height, cross-sectional shape and line of the groyne 15 will depend on the particular morphological and current condtions at a given bifurcation.

Figure 8:
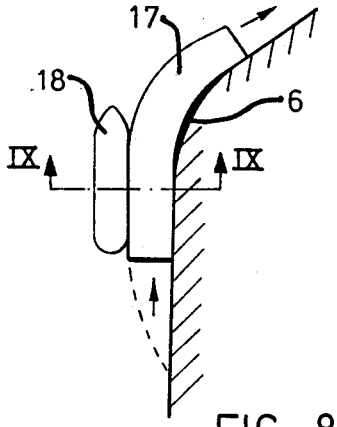
FIG. 8 is a schematic plan view of the upstream corner of a channel bifurcation modified by the provision of flow-deflecting means according to a seventh embodiment of the invention.

FIG. 8 shows a variant of the embodiment of FIG. 2, in which an additional wall 16 has been built up around the curve 6 and the channel 5 has been roofed over by a flat roof 17 supported by the walls 7 and 16. The structure may thus be used as a wharf and a ship 18 is shown schematically alongside the wall 7. The shape of the channel 5 may be modified is explained above.

Figure 11:
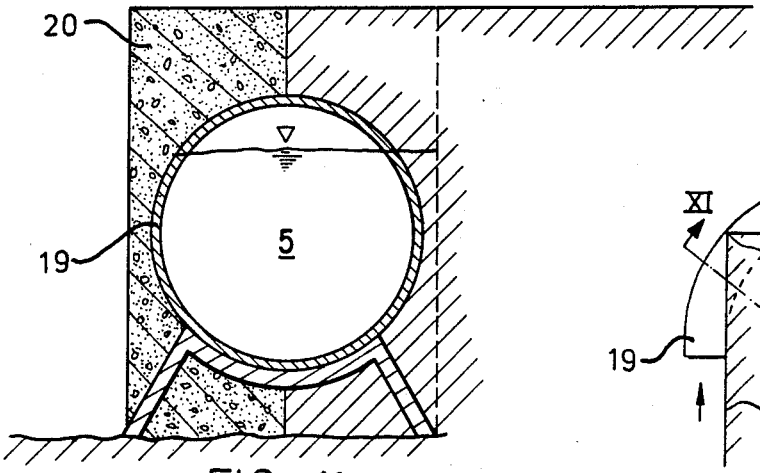
FIG. 11 is a section taken on lines XI—XI of FIG. 10.
Figure 10:
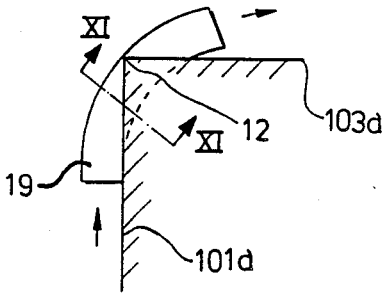
FIG. 10 is a schematic plan view of the upstream corner of a channel bifurcation modified by the provision of flow-deflecting means according to an eighth embodiment of the invention.

FIG. 10 shows an embodiment in which the channel 5 is defined, not by vertical walls as in the previous embodiments, but by a large-diameter pipe 19. This may extend through the corner 12, as shown in FIG. 10 and may be encased in a wharf structure as shown at 20 in FIG. 11.

Figure 12:
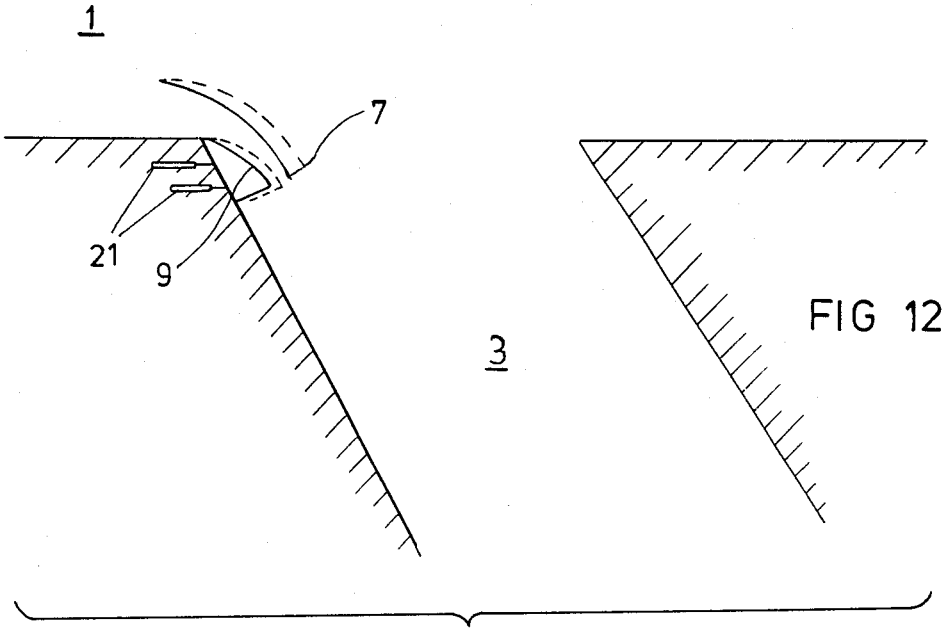
FIG. 12 is a schematic plan view of a channel bifurcation modified by a further embodiment of flow-deflection means according to the invention.

With reference to FIG. 12, this shows schematically an embodiment in which the positions of a deflecting wall 7 and/or of a spur wall 9 can be adjusted by means, for example, of respective actuators 21 to vary the geometry of the entrances to the branch channel 3 and the deflection channel 5. This has the object of optimising the direction of the current 8 and the percentage of the cross-section of the branch 3 to be blocked. In FIG. 12 the spur-wall 9 and wall 7 are shown in full outline at one extreme position of their movements and in broken outline at the opposite extremes of their movements.

The invention thus deals with the prevention of unwanted eddy currents in bifurcations such as harbour basins, canals etc. by the positioning of current deflecting walls near the point of bifurcation to a branch channel to separate part of the stream and direct a counter-current to prevent the formation of a major eddy at the entrance to the branch. Arising from the intrinsic variability of natural waterways and artificial harbours the precise shape, dimensions and position of the CDW channel must be tailored to take account of local conditions in order to provide the optimal alignment of the counter-current and minimise unwanted sediment deposition.

The implication is that field data must be collected and a physical or other model constructed on each occasion to enable an appropriate current deflecting wall 7 to be built and any other modifications to be made.

Certain criteria have been established from physical model tests upon which to base the design of a flow deflection channel 5 at the entrance to a harbour basin. A formula has been developed as follows:

$$S_{FD} = \frac{A_{HBR} \times TR}{V_{FD} \times D_F} \quad (1)$$

$S_{FD}$=Cross-sectional area of FD channel 5 ($m^2$)
$A_{HBR}$=Surface area of harbour ($m^2$)
TR=Tidal Range (m)
$V_{FD}$=Cross-sectional depth mean velocity during flood tide (m/sec)
$D_F$=Duration of flood tide (sec)

Assuming that the flow pattern created by the deflection channel blocks the bifurcation, as has been proved possible by physical model tests, the purpose of the formula is to permit the scaling of the flow deflection channel in tidal waters in such a way that the volume of water passing through it is just sufficient to fill the blind-ending basin completely (i.e. the tidal volume) at high water. For non-tidal situations the objective of design is to produce sufficient energy in the counter-current just to overcome the kinetic energy in the rotating major eddy. From a consideration of the forces responsible for driving the rotating major eddy in the branch channel, it has been shown by calculation that these are zero when the current vector at the mouth of the branch channel is parallel to the sides of the channel. This condition is satisfied over a significant proportion of the flood tide provided:

$$S_{FD} = \sqrt{\frac{\pi \times A_{HBR} \times TR \times \cos(\phi)}{TP \times \tan(\sigma) \times V_{MAX}}}$$

TP=Tidal period (sec)
$\phi$=Phase lag between slack water and low water (degrees)
$\theta$=Angle between branch and mainstream (degress)
$V_{MAX}$=Maximum value of cross-sectional mean current velocity (m/sec)

The two formulae given for the cross-sectional area of the current deflection channel agree to within 20% for all cases. Consequently, the current deflection acts in two ways to reduce the strength of the entrance eddy:

(i) it minimises the energy transfered into the eddy
(ii) it dissipates some or all of the energy which is concentrated in the eddy.

In order to achieve a smooth channel for both walls of the deflection channel it may be desirable to reform or re-align the original junction, or corner, between the main flow and the branch at its "upstream" end i.e. the flow separation point, by for example cutting away the corner as shown at 6 in FIG. 2. Practical factors such as the cost or the need to maintain the maximum size opening to the bifurcation or basin must, however, be taken into account.

Alternatively, if calculations demonstrate that the bifurcation is wider than the optimal size and practical considerations permit, the revised inner curve can be designed to-project into the branch at the point of bifurcation, thus restricting the cross-sectional area of the entrance to the branch, as shown in the embodiment of FIG. 3. The additional spur-wall extends over the full water depth and has a shape, when viewed from above, of a truncated hydrofoil. The spur-wall serves the twin purposes of aligning the flow in the channel 5 and "tuning" the cross-sectional area of the branch to its optimum. Other modifications such as those indicated in other embodiments described above may also be included as appropriate.

It will be appreciated that the use of Formula I above will permit the specification of a flow deflection channel for tidal situations. In non-tidal situations the preferred cross-section of the channel has been found from model tests to lie roughly in the region 10% of the total cross-sectional area of the branch. This is found to generate sufficient kinetic energy to overcome the major eddy current.

What is claimed is:

1. The combination of a main channel carrying a main water flow in an upstream to downstream direction, a branch channel birfurcating from said main channel to define both an upstream corner and a downstream corner of the entrance to the branch, flow deflecting means located adjacent the upstream corner for deflecting a minor proportion of said main water flow from the main channel into the branch channel so as to oppose the formation of eddies in the branch channel in the region of said bifurcation and thereby diminish the deposition of sediment in said region.

2. The combination as claimed in claim 1, where said flow deflecting means is constituted by a wall defining, at least in part, a flow deflection channel which extends around said upstream corner and which has an inlet within said main channel for receiving water therefrom and an outlet in said branch channel.

3. The combination as claimed in claim 2, wherein said wall is substantially vertical, extends substantially the full depth of said water flow, and is spaced from said upstream corner to define one side of said flow deflection channel.

4. The combination as claimed in claim 3, further including a substantially conical section base commencing at said flow-deflecting wall at its upstream end and extending upstream thereof and towards that, bank of said main channel which is common to said upstream corner and meeting said bank upstream of said inlet to said flow deflection channel, the conical section base having a height substantially less than the depth of water in said main channel.

5. The combination as claimed in claim 2, in which the said wall defines apertures for allowing water to escape from said deflection channel.

6. The combination as claimed in claim 2 wherein said wall includes a spur wall projecting from said upstream corner into said branch channel and defining at least part of the side of said flow deflection channel opposite said flow deflecting wall.

7. The combination as claimed in claim 6, including means for altering the conformation of said flow deflection channel by adjusting the position of at least one of said wall and said spur wall.

8. The combination as claimed in claim 7, wherein said means for altering the conformation of said flow deflection channel comprise at least one hydraulic ram.

9. The combination as claimed in claim 2, wherein said flow deflection channel narrows from said inlet to said outlet.

10. The combination as claimed in claim 2, including a roof structure extending from said wall to the joined banks of said main channel and said branch channel which are contiguous to and define said upstream corner so as to cover at least part of said flow detection channel.

11. The combination as claimed in claim 2, wherein said wall is of tubular cross section and defines said flow deflection channel except at said inlet and said outlet.

12. The combination as claimed in claim 2, for use at a bifurcation of a harbour basin from a main channel subject to tidal flow, wherein said flow deflection channel is designed to have a cross-section which accords with the following formula:

$$S_{FD} = \frac{A_{HBR} \times TR}{V_{FD} \times D_F} \quad (1)$$

where:

$S_{FD}$=Cross-sectional area of FD channel 5 ($m^2$)

$A_{HBR}$=Surface area of harbour ($m^2$)

TR=Tidal Range (m)

$V_{FD}$=Cross-sectional depth mean velocity during flood tide (m/sec)

$D_F$=Duration of flood tide (sec).

13. The combination as claimed in claim 1, wherein said flow deflecting means is constituted by a series of substantially-vertical walls extending substantially the full depth of said water flow so as to define a flow-deflection channel extending adjacent said upstream corner and having an inlet within said main channel for receiving water therefrom and or main outlet within said branch channel, adjacent ends of said walls being spaced apart to define subsidiary outlets for allowing water to escape from said deflection channel.

* * * * *